US007591875B2

(12) United States Patent
Zhou

(10) Patent No.: US 7,591,875 B2
(45) Date of Patent: Sep. 22, 2009

(54) ALLOYING FINE ADJUSTMENT METHOD

(75) Inventor: Jianan Zhou, MaAnShan (CN)

(73) Assignee: Huatian Engineering & Technology Corporation, MMC, Maanshan (CN)

( * ) Notice: Subject to any disclaimer, the term of this patent is extended or adjusted under 35 U.S.C. 154(b) by 0 days.

(21) Appl. No.: 11/943,911

(22) Filed: Nov. 21, 2007

(65) Prior Publication Data

US 2008/0121072 A1 May 29, 2008

(30) Foreign Application Priority Data

Nov. 23, 2006 (CN) ..... 2006 1 0097948

(51) Int. Cl.

| | |
|---|---|
| ***C21C 5/04*** | (2006.01) |
| ***C21C 1/06*** | (2006.01) |
| ***C22B 1/06*** | (2006.01) |
| ***C21C 5/56*** | (2006.01) |

(52) U.S. Cl. ..... 75/526; 75/330

(58) Field of Classification Search ..... 75/526
See application file for complete search history.

(56) References Cited

U.S. PATENT DOCUMENTS 3,728,109 A * 4/1973 Okubo et al. ..... 75/543
3,869,283 A * 3/1975 Davies et al. ..... 420/86
3,884,453 A * 5/1975 Pearce et al. ..... 266/83
4,414,025 A * 11/1983 Yang ..... 75/532
5,620,521 A * 4/1997 Tachikawa et al. ..... 118/717

OTHER PUBLICATIONS

Zengqi Xu, "Secondary Refining", Metallurgical Industry Press, p. 90, (2005) (Attached and referred to as Document 1).
Juhe Feng, et al., "Hot Metal Pretreatment and Secondary Refining of Molten Steel", Metallurgical Industry Press, p. 234, (2006) (Attached and referred to as Document 2).
Translation of portion of p. 90 of the attached Document 1 and p. 234 of the attached Document 2 (Attached and referred to as Document 3), (2005 and 2006).

* cited by examiner

*Primary Examiner*—Melvin C Mayes
*Assistant Examiner*—Sarah Van Oudenaren
(74) *Attorney, Agent, or Firm*—Workman Nydegger

(57) ABSTRACT

The present invention discloses a type of alloying fine adjustment method in which alloy materials are pulverized into micropowder and fed via the conventional powder spraying system; the said alloy materials are fed into the upper part of the spraying tank of the spraying system whose spraying pipelines are connected to the aerated bricks at the bottom of the molten steel container. Based on the existing argon blowing and mixing system, argon is taken as the carrier and used to pressurize the alloy powders into the aerated bricks at the bottom of the molten steel container via the spraying system and further into the molten steel container for the sake of alloying fine adjustment. After the alloy powders are fed, continue blowing and mixing argons until the alloy powders and the molten steels are evenly mixed in the molten steel container to complete the alloying process. This method features such advantages as short alloying time, good alloying effects, high yield of alloys and absence of pollution.

4 Claims, 1 Drawing Sheet

ALLOYING FINE ADJUSTMENT METHOD

CROSS-REFERENCE TO RELATED APPLICATIONS

This application claims the benefit of priority under 35 U.S.C. § 119 to Chinese Patent Application No. 200610097948.9, filed on Nov. 23, 2006, having a translated title of "Alloying Fine Adjustment Method," the content of which is hereby incorporated by reference in its entirety.

BACKGROUND OF THE INVENTION

1. The Field of the Invention

The present invention is related to steel metallurgy. In particular, the present invention relates to the microalloying technique of steelmaking during the process of metallurgy.

2. The Relevant Technology

Alloying is the most important technical process in metallurgy. Ever since the commencement of metallurgical industry, the technical study and development in this field has become the focus of study among all metallurgical professionals. The contents of various alloy elements in different types of steels will directly influence the quality and properties of metallurgical products. Traditional microalloying of steels mainly include "block addition method" and "feed wire method".

Block Addition Method

In block addition method, block alloys are mechanically fed into the molten steel container while tapping or refining and argons are blown into the container where the alloys and molten steels are stirred together so that alloys are evenly distributed in the molten steels and alloying fine adjustment is done.

Considering that block alloys have a small contact surface area with molten steels and the melting time is long, part of the alloys will have been mixed with the slag before melting and reaction, thus causing severe segregation, a low yield rate of alloy, poor control of components and easy to cause waste product with unqualified molten steels. In addition, this method requires high equipment investments and easily leads to environment pollution.

Feed Wire Method

In feed wire method, alloys are directly made into wires. Those alloys that can't be directly made into wires will be pulverized firstly and then wrapped in iron sheet to be cored-wire. According to the technical requirements of steelmaking, the wires are normally fed into the molten steels with dedicated equipment after completion of refining for the sake of composition adjustment.

Wire feeding must be carried out together with argon blowing and mixing. This method still have such deficiencies as low yield rate, long processing period, uneven temperature and steel quality and splashing that would easily cause dead welding of wire feeding pipeline. In addition, wire feeding machine requires substantial repair work and there are stringent requirements on the fabrication of iron-wrapped wires.

BRIEF SUMMARY OF THE INVENTION

The present invention is expected to overcome the deficiencies of current technologies by providing an alloying fine adjustment method. It is used to adjust the chemical composition of molten steels by changing the shape and feeding method of alloy materials, thus satisfying the requirements of different steel types on chemical composition and realizing alloying fine adjustment.

To achieve the abovementioned purpose, the alloying fine adjustment method of the present invention comprises following steps: alloy materials are pulverized and fed via the conventional powder spraying system; the alloy powders of are fed into upper part of the spraying tank of the spraying system whose spraying pipelines are connected to the aerated bricks at the bottom of the molten steel container. Based on the existing argon blowing and mixing system, argon is taken as the carrier and used to pressurize the alloy powders into the aerated bricks at the bottom of the molten steel container via the spraying system and further into the molten steel container for the sake of alloying fine adjustment. After the alloy powders are fed, continue blowing and mixing argons until the alloy powders and the molten steels are evenly mixed in the molten steel container to finish the alloying process.

The present invention requires pulverizing the alloy materials into micropowder with the granularity less than 300 meshes. Easily oxidizable alloy materials need to be passivated to increase the fluidity of powders and avoid oxidation.

The present invention has the following advantages compared with the present technology: (i) alloy materials are pulverized into micropowder which substantially increase the reaction interface; (ii) highly-pressurized powder flows will induce strong agitation in the molten steels to shorten the alloying time, substantially improve the kinetic conditions of metallurgical reaction, promote the homogenization of alloys in steels, increase the yield rate of alloys, increase the recurrence and accuracy of alloy dosage and control the composition of molten steels within a narrow range; and (iii) have such advantages as absence of pollution, low investment, lightweight and compact equipment and easy operation.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawing. It is appreciated that this drawing depicts only a typical embodiment of the invention and is therefore not to be considered limiting of its scope. The invention will be described and explained with additional specificity and detail through the use of the accompanying drawing in which.

DETAILED DESCRIPTION OF THE PREFERRED EMBODIMENTS

Figure 1:
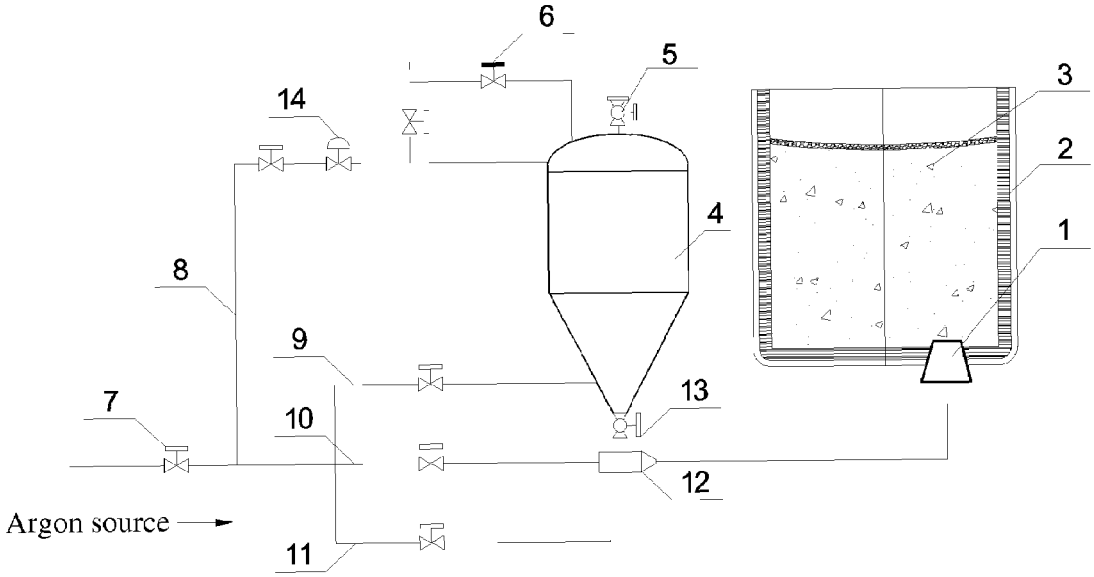
FIG. 1 illustrates alloying fine adjustment system of the present invention.

As FIG. 1 shows, the alloying fine adjustment method of the present invention is realized with a conventional powder spraying system. The spraying pipeline is connected to aerated bricks 1 at the bottom of molten steel container 2. The alloy materials are pulverized into micropowder with the granularity less than 300 meshes. Easily oxidizable alloy materials need to be passivated to increase the fluidity of powders and avoid oxidation. Alloy powders are fed via the top of powder spraying tank of the spraying system Based on the existing argon blowing and mixing system, argon is taken as the carrier and used to pressurize the alloy powders into the aerated bricks 1 at the bottom of the molten steel container 2 via the spraying system and further into the molten steel container 2 for the sake of alloying fine adjustment.

Embodiment 1

100 kw/150 kg medium-frequency induction multifunctional high-temperature furnace is adopted in the laboratory for smelting of Q235B steels. The molten steel output is about 100 kg and post-deoxidation test shows [Mn] is less than 0.20 wt % as against the target requirement of [Mn]:0.50.

The operating procedure of alloying is illustrated as follows:

First of all, open the vent valve 6 and the feeding valve 5; 0.39 kg 300-meshes alloy powders-low-carbon ferromanganese powders (the content of manganese is 85 wt %) are fed into the spraying tank 4 with 0.1m3 and aerate it to a pressure of 0.3 MPa. At this moment, a certain quantity of alloy powders in the upper part of the feeding port will be fed into the spraying tank 4 via the feeding port; close feeding valve 5 and vent valve 6. Meanwhile, open pneumatic inlet valve 7 so that the argon flows into the four branch pipes. The argon in the $1^{st}$ branch pipe pressurizes the low-carbon ferromanganese powders in spraying tank 4 via pressurizing tube 8 and the pressure is regulated to the expected value via pressure regulating valve 14; the argon in the $2^{nd}$ branch pipe flows into the cone one-stage fluidizing chamber of the spraying tank via the $1^{st}$-stage gasifying tube 9 and fluidizes the low-carbon ferromanganese powders with the help of the gasifying device inside the cone chamber; the argon in the $3^{rd}$ branch pipe enters mixing chamber 12 via $2^{nd}$-stage gasifying tube 11 and further fluidizes the low-carbon ferromanganese powders with the help of the fluidizing device provided inside of the said mixing chamber; the argon in the $4^{th}$ branch pipe blows out the fluidized low-carbon ferromanganese powders via jet pipe 10. Open discharge valve 13 when the pressure in the spraying tank reaches the set value. Spraying tank 4 is in operation and ready to spray alloy powders into molten steel container 2.

After the low-carbon ferromanganese powders are sprayed, continue blowing argons for about 3 minutes so that the alloy powders are evenly mixed with the molten steels 3 in molten steel container 2 to finish the alloying process.

Inspection shows that the yield rate of manganese in the ferroalloy is about 90% with good alloying effects.

Embodiment 2

A kind of #20 steels produced by a converter steelmaking factory is adopted. FeSi75-B powders in a granularity of 350 meshes are sprayed into the molten steel container that contains 40 t molten steels.

The post-oxidation inspection results show the [Mn]:0.50 and [Si]:0.15 both reach the target requirement. The target requirement is [Si]:0.25.

62.75 kg FeSi75-B powders are sprayed into the molten steel container via a 0.3m3 spray tank for the sake of alloying fine adjustment. The operating procedure is as the same as that specified in Embodiment 1.

The inspection shows that the yield rate of silicon in ferroalloy is about 85% with good metallurgical effects.

Embodiment 3

In case of 120 t converter with an output of 120 t 09 MnV steels, 300-meshes ferrovanadium powders (FeV75-B) are sprayed into a 120 t molten steel container.

The post-oxidation inspection results show that [Mn]:1.1 (the target value have been satisfied), [Si]:0.3 (the target value have been satisfied) and [V]: 0.08.

130.6 kg ferrovanadium powders are sprayed into the molten steel container via a 0.3 $m^3$ spray tank for the sake of alloying fine adjustment of molten steels.

The operating procedure is as the same as that specified in Embodiment 1. The inspection shows that the yield rate of vanadium is about 95% which is a good result indeed.

The present invention shortens the alloying time, promotes the homogenization of alloys in steels, increases the yield rate of alloys and avoids environmental pollution. It also has such advantages as low investment, lightweight and compact equipment and easy operation.

Further modifications may be made without departing from the scope of the invention herein intended. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An alloying fine adjustment method comprising the steps of:

pulverizing alloy materials;

feeding said pulverized alloy materials into an upper part of a spraying tank whose spraying pipelines are connected to aerated bricks at the bottom of a molten steel container;

utilizing argon as a carrier to pressurize said pulverized alloy materials;

spraying said pulverized alloy materials into said aerated bricks at the bottom of said molten steel container and further into molten steel material within said molten steel container for the sake of alloying fine adjustment;

blowing and mixing argon into said molten steel container after said pulverized alloy materials are sprayed until said pulverized alloy materials and said molten steel material are mixed in said molten steel container.

2. The alloying fine adjustment method as claimed in claim 1, wherein, the alloy materials, which easily oxidize, still need to be passivated to increase the fluidity of powders and avoid oxidation.

3. The alloying fine adjustment method as claimed in claim 2, wherein, the said alloy materials need to be pulverized into micropowder with a particle granularity less than about 0.05 mm, so as to be able to pass through a mesh size of 300 or greater.

4. The alloying fine adjustment method as claimed in claim 1, wherein, the said alloy materials are pulverized into micropowder with a particle granularity less than about 0.05 mm, so as to be able to pass through a mesh size of 300 or greater.

* * * * *